United States Patent [19]

Igarashi et al.

[11] Patent Number: 4,761,624

[45] Date of Patent: Aug. 2, 1988

[54] MICROWAVE BAND-PASS FILTER

[75] Inventors: Sadao Igarashi; Moriaki Ueno, both of Soma, Japan

[73] Assignee: Alps Electric Co., Ltd., Japan

[21] Appl. No.: 28,608

[22] Filed: Mar. 20, 1987

[30] Foreign Application Priority Data

Aug. 8, 1986 [JP] Japan ..... 61-186631

[51] Int. Cl.[4] ..... H01P 1/205; H01P 1/202

[52] U.S. Cl. ..... 333/206; 333/202; 333/203

[58] Field of Search ..... 333/202, 203, 206, 207–212, 333/222–226, 245

[56] References Cited

U.S. PATENT DOCUMENTS 4,255,729 3/1981 Fukasawa et al. ..... 333/202

4,342,972 8/1982 Nishikawa et al. ..... 333/206

OTHER PUBLICATIONS

La Tourrette–"Wide-Bandwidth Combline Filters with High Selectivity", Conference: 1979 IEEE MTT-S International Microwave Symposium Digest, Orlando, FL, U.S.A.; (Apr. 30–May 2, 1979); pp. 275–277.

*Primary Examiner*—Marvin L. Nussbaum

*Attorney, Agent, or Firm*—Guy W. Shoup; Leighton K. Chong

[57] ABSTRACT

A microwave band pass filter comprises a band pass filter of the coaxial type which is formed by connecting plural coaxial type resonators in series through capacitors, and another band pass filter of the comb line type connected in series to the coaxial type band pass filter, wherein lower cutoff frequencies for the coaxial type band pass filter are included in a pass band for the comb line type band pass filter while higher cutoff frequencies for the comb line type band pass filter are included in a pass band for the coaxial type band pass filter, so that the skirting characteristic can be made sharp at high and low bands even with fewer resonator stages.

3 Claims, 4 Drawing Sheets

MICROWAVE BAND-PASS FILTER

BACKGROUND OF THE INVENTION (a) Field of the Invention

The present invention relates to a microwave band-pass filter whose skirting characteristic has been improved to become sharp at high and low bands.

(b) Prior Art

Needs for radio communication have become larger and larger these days and the number of radio waves used is increasing in a same area. In order to eliminate any jamming entering from other systems, therefore, it is asked that the band-pass filter (which will be hereinafter referred to as BPF) arranged in the input/output section of the radio has a sharp skirting characteristic at high and low bands. In the case of moving and portable radios, the BPF is desired to become small-sized and light-weighted.

Dielectric filters such as the coaxial and comb line type BPFs have been therefore used as the BPF arranged in the input/output section of the radio.

The BPF of the coaxial type will be briefly described with reference to FIGS. 4 and 5, of which FIG. 4 is a perspective view showing the coaxial type BPF and FIG. 5 a circuit diagram showing the coaxial type BPF in FIG. 4.

In FIG. 4, the BPF 50 of the coaxial type comprises cylindrical dielectric coaxial type resonators 51–55 each having a hole therein, and inner conductors 56–60 formed on the inner walls of the holes and connected one another in series between terminals 61 and 62 through capacitors 63–68.

The circuit of this coaxial type BPF 50 is of the capacity coupling type in which the coaxial type resonators 51–55 are connected one another in series through the capacitors 64–67, as shown in FIG. 5. Numerals 69–73 represent fringing capacities and 74–78 their equivalent coaxial lines.

The BPF of the comb line type will be now briefly described referring to FIGS. 6 and 7, of which FIG. 6 is a perspective view showing the comb line type BPF and FIG. 7 a circuit diagram showing the comb line BPF in FIG. 6.

In FIG. 6, the BPF 80 of the comb line type comprises providing holes in a rectangular-parallelepiped-shaped dielectric 81 along a center line thereof with an equal interval interposed between them, plating the inner walls of the holes to form inner conductors 82–86, forming conductors on the faces of the dielectric 81 except the top face thereof at which the holes are opened, and connecting the inner conductors 82 and 86 located on both end to terminals 87 and 88, respectively, through capacitors 89 and 90.

The equivalent circuit of this comb line type BPF 80 is of the inductive coupling type in which the resonators are induction-coupled by equivalent coaxial lines 91–94. Numerals 95–99 represent fringing capacities and 100,104 equivalent coaxial lines.

The conventional microwave BPF comprises combining the coaxial or comb line type BPFs 50 or 80 in an appropriate number of stages.

The coaxial type BPF 50 has a skirting characteristic sharp at low band but gentle at high band and its attenuation amount is not sufficient, as shown by A in FIG. 3. On the other hand, the comb line type BPF 80 has a skirting characteristic sharp at high band but gentle at low band and its attenuation amount is not sufficient, as shown by B in FIG. 3. In order to make their skirting characteristics sharp at both high and low bands, therefore, the number of the resonator stages must be increased. However, this causes the dielectric constant of the dielectric, which forms the resonators, and their dimensional irregularities to have larger influences, thereby increasing loss in pass band and worsening return loss characteristic. When the number of the resonator stages is increased like this, it also takes a longer time to adjust the resonators, thereby becoming unsuitable for mass production.

In the case of both of the coaxial and comb line type BPFs 50 and 80, a pass band where the attenuation amount is small is present, as shown by D in FIG. 3, at those frequencies which are three times the frequencies in the pass band shown left side in FIG. 3, thereby causing spurious characteristic. A low pass filter must be added to improve this spurious characteristic.

SUMMARY OF THE INVENTION

The present invention is intended to eliminate the above-mentioned drawbacks of the conventional microwave BPF.

The object of the present invention is therefore to provide a microwave BPF arranged to have a small number of stages and a sharp skirting characteristic at high and low bands.

This object of the present invention can be achieved by a microwave BPF comprising a BPF of the coaxial type including plural coaxial type resonators connected in series through capacitors, and a BPF of the comb line type connected in series to the coaxial type BPF, wherein the lower cutoff frequency of the coaxial type BPF is in the pass band of the comb line type BPF and the higher cutoff frequency of the comb line type BPF is in the pass band of the coaxial type BPF.

The coaxial type BPF is connected in series to the comb line type BPF and the lower cutoff frequency of the coaxial type BPF is in the pass band of the comb line type BPF, so that the skirting characteristic can be made sharp at low band by the coaxial type BPF, relating to the lower cutoff frequency of the microwave BPF. In addition, the higher cutoff frequency of the comb line type BPF is in the pass band of the coaxial type BPF, so that the skirting characteristic can be made sharp at high band by the comb line type BPF, relating to the higher cutoff frequency of the microwave BPF.

DETAILED DESCRIPTION OF THE PREFERRED EMBODIMENT

Figure 1:
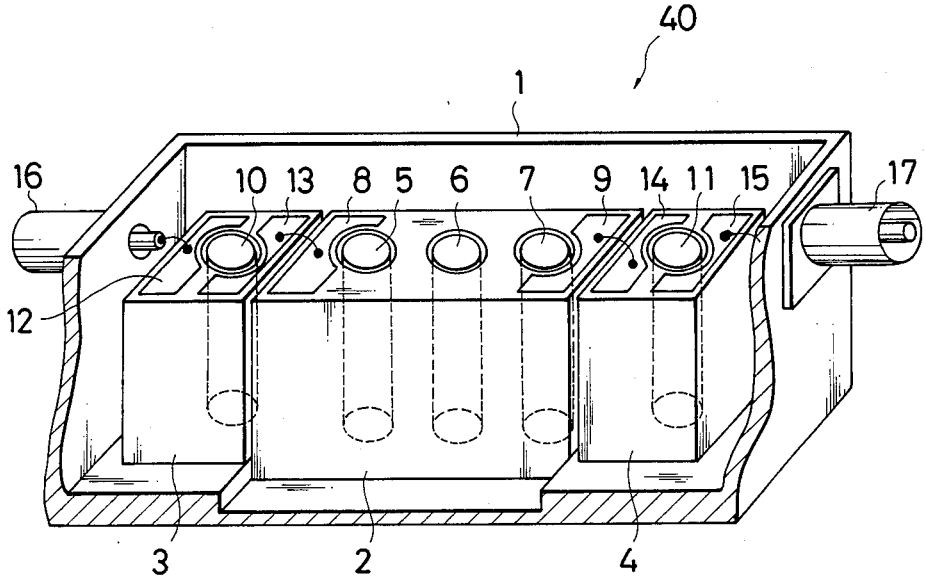
FIG. 1 is a perspective view showing an example of the microwave BPF of the present invention partly cut away.
Figure 2:
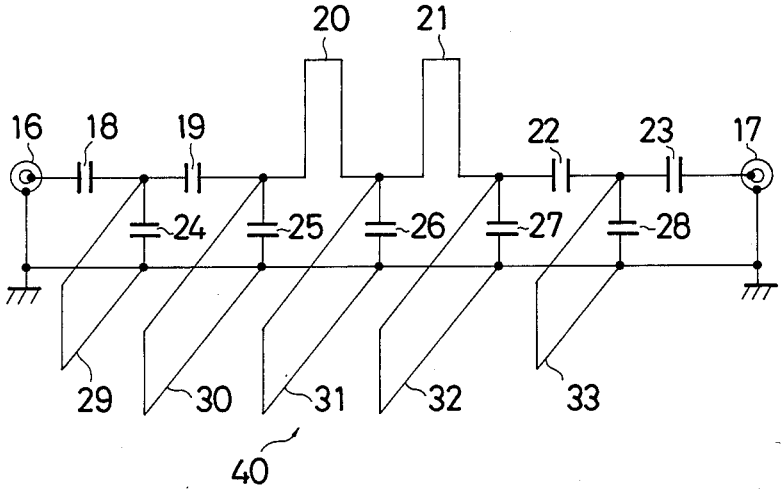
FIG. 2 is a circuit diagram showing the microwave BPF in FIG. 1.
Figure 3:
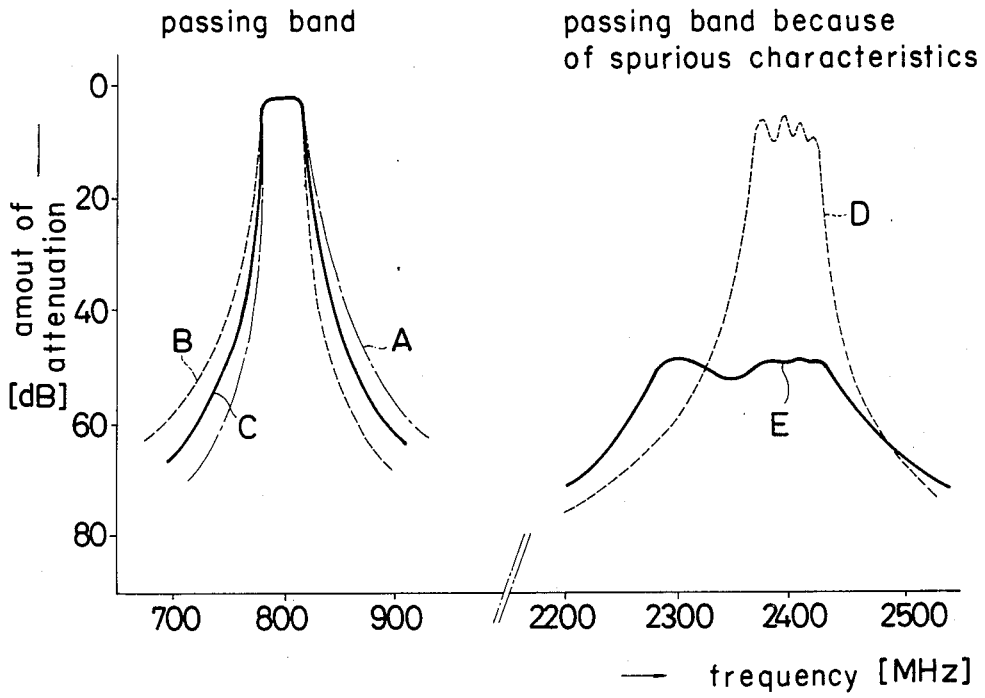
FIG. 3 shows characteristics of the microwave BPF in FIG. 1.
Figure 4:
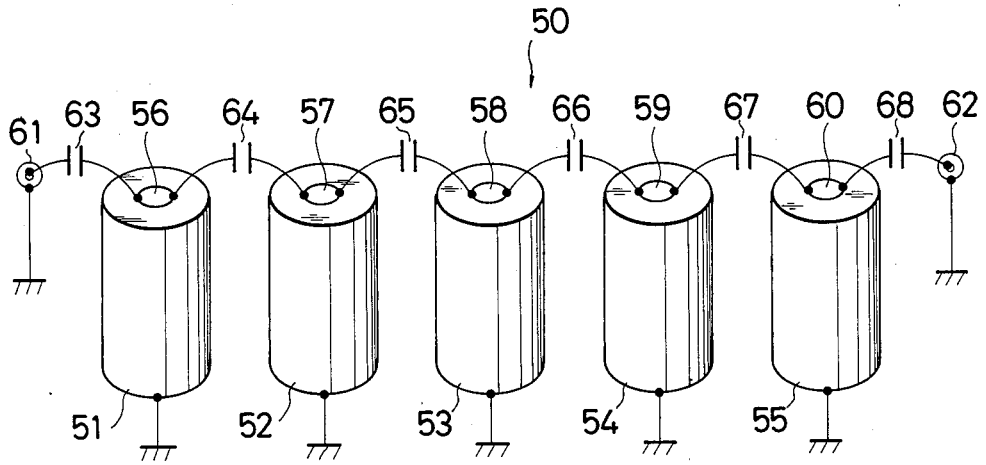
FIG. 4 is a perspective view showing a BPF of the coaxial type.
Figure 5:
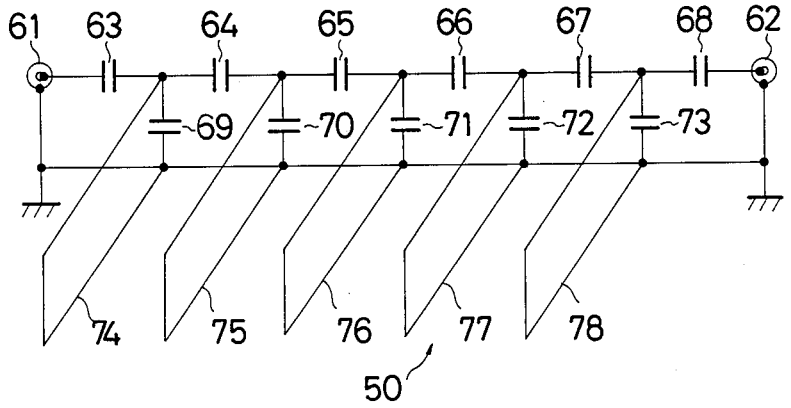
FIG. 5 is a circuit diagram showing the BPF in FIG. 4.
Figure 6:
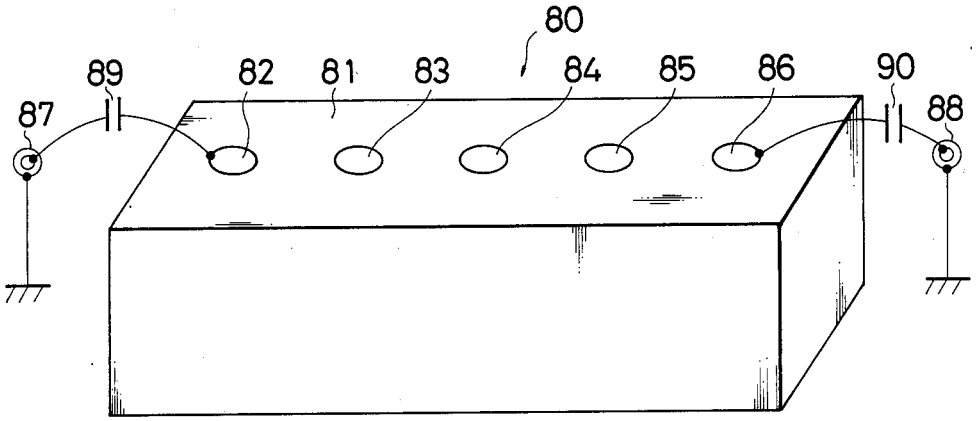
FIG. 6 is a perspective view showing a BPF of the comb line type.
Figure 7:
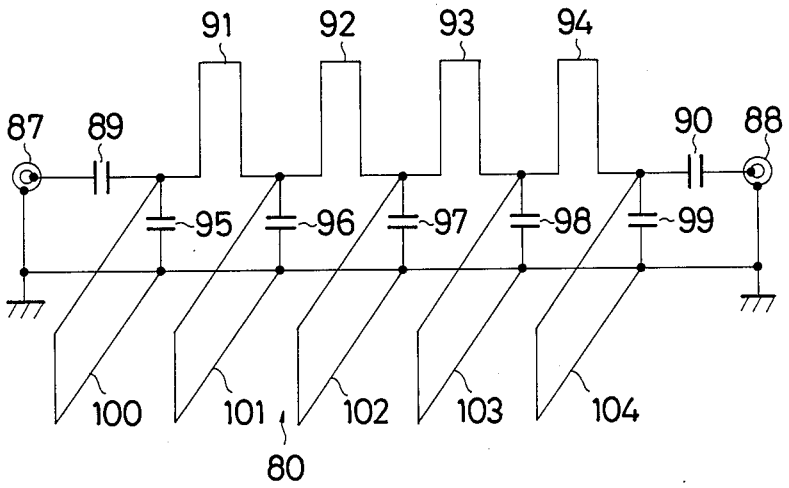
FIG. 7 is a circuit diagram showing the BPF in FIG. 6.

An embodiment of the present invention will be described with reference to FIGS. 1 through 3, of which FIG. 1 is a perspective view showing an example of the microwave BPF of the present invention partly cut away, FIG. 2 a circuit diagram showing the microwave BPF in FIG. 1, and FIG. 3 shows characteristics of the microwave BPF in FIG. 1.

A rectangular-parallelepiped-shaped dielectric 2 is arranged in a metal box 1, having dielectric blocks 3 and 4 located on both sides thereof. Holes are provided in the dielectric 2 on a center line thereof and the inner walls of the holes are plated to form inner conductors 5–7. Conductors are also formed on the faces of the dielectric 2 except the top face thereof at which the holes are opened. Electrodes 8 and 9 adjacent to the inner conductors 5 and 7, respectively, are arranged on the top face of the dielectric 2. Holes are also formed in the dielectric blocks 3 and 4, respectively, at the centers thereof and the inner walls of these holes are plated to form inner conductors 10 and 11. Conductors are also formed on the faces of the dielectric blocks 3 and 4 except the top faces thereof at which the holes are opened, thereby providing resonators of the coaxial type. Two electrodes 12, 13 and other two electrodes 14, 15 are arranged, adjacent to the inner conductors 10 and 11 respectively, on the top faces of the dielectric blocks 3 and 4. The metal box 1 is provided with input and output connectors 16 and 17, one 16 of which is connected to one 12 of the electrodes on the dielectric block 3 through a conductor and the other electrode 13 is connected to one 8 of the electrodes on the dielectric 2 through a conductor. The other electrode 9 on the dielectric 2 is connected to one 14 of the electrodes on the dielectric block 4 through a conductor and the other electrode 15 is connected to the other connector 17 through a conductor.

A circuit for a microwave BPF 40 arranged as described above comprises the resonators connected one another in series between the connectors 16 and 17 through a capacitor 18 which is formed by the electrode 12, a capacitor 19 which is formed by the electrodes 13 and 8, equivalent coaxial lines 20 and 21, a capacitor 22 which is formed by the electrodes 9 and 14, and a capacitor 23 which is formed by the electrode 15, as shown in FIG. 2.

Therefore, the resonators of the coaxial type in the dielectric blocks 3 and 4 which are connected in series through the capacitors 18, 19, 22 and 23 provide the coaxial type BPF, while the resonators in the dielectric 2 which are connected in series through the equivalent coaxial lines 20 and 21 provide the comb line type BPF. Numerals 24–28 in FIG. 2 represent fringing capacities and 29–33 equivalent coaxial lines.

As described above, the microwave BPF of the present invention comprises connecting the coaxial type BPF to the comb line type BPF in series. And the lower cutoff frequency of this coaxial type BPF is included in the pass band for the comb line type BPF, so that the skirting characteristic of the microwave BPF 40 can be made sharp at low band by the coaxial type BPF. The higher cutoff frequency of the comb line type BPF is included in the pass band for the coaxial type BPF, so that the skirting characteristic of the microwave BPF 40 can also be made sharp at high band by the comb line type BPF. Therefore, the microwave BPF 40 shows a sharp skirting characteristic at high and low bands, as shown by C in FIG. 3.

In the case of the microwave BPF which is formed by combining the resonators in five or more stages, the microwave BPF can be made one stage less to achieve same performance, as compared with the conventional BPF according to tests conducted by the inventor.

The length of each of the equivalent coaxial lines 29 and 33 for the coaxial type resonators in the dielectric blocks 3 and 4 is shorter thanks to the capacitors 18, 19, 22 and 23 than that of each of the equivalent coaxial lines 30–32. Because these equivalent coaxial lines 29–33 are different in length, center frequencies in the pass band for the coaxial and comb line type BPFs which form the microwave BPF become different and resonance frequencies which are three times larger than those in this pass band also differ greatly between the coaxial type BPF and the comb line type BPF, thereby improving the spurious characteristic efficiently, as shown by E in FIG. 3.

Although the resonators have been arranged in five stages in the case of the above-described embodiment, it should be understood that the present invention is not limited to this five-stage embodiment.

According to the microwave BPF of the present invention as described above, the skirting characteristic can be made sharp at high and low bands and the number of the resonator stages can be made fewer, as compared with the conventional microwave BPF. In addition, loss in the pass band can be reduced due to the fewer resonator stages. Further, the range of irregularities which are allowed for dielectric constants and dimensions of the dielectrics and dielectric blocks can be made wider, thereby making the microwave BPF of the present invention most suitable for mass production. Furthermore, the spurious characteristic can be improved better, as compared with the conventional BPF.

We claim:

1. A microwave band pass filter for obtaining a sharp skirting characteristic on a low frequency side of a passing band, such as obtained in a coaxial type band pass filter (BPF), as well as on a high frequency side of the passing band, such as obtained in a combline type BPF, comprising in series at least the following:

a first dielectric block having a resonator providing a coaxial type BPF having a characteristic of lower cutoff frequencies which is formed by a hole lined with an inner conductor and a pair of leading and trailing electrodes on a face of said block in one direction spaced on each side of an end of said hole;

a second dielectric block having a plurality of resonators providing a combline type BPF having a characteristic of higher cutoff frequencies which is formed by respective holes spaced apart in parallel and in series, each lined with an inner conductor, and a pair of leading and trailing electrodes on a face of said block in the one direction spaced on each side of the series of holes; and a third dielectric block having a resonator providing a coaxial type BPF having a characteristic of lower cutoff frequencies which is formed by a hole lined with an inner conductor and a pair of leading and trailing electrodes on one face of said block in the one direction spaced on each side of an end of said hole, wherein the lower cutoff frequencies for said coaxial type BPF are included in a passing band for the combline type BPF, and the higher cutoff frequency for the combline type BPF are included in a pass band for the coaxial type BPF, and wherein the trailing electrode of said first block is connected to the leading electrode of said second block, and the trailing electrode of said second block is connected to the leading electrode of said third block, whereby the low frequency side skirting characteristic of a coaxial type BPF is obtained by the resonators of said first and third blocks being connected through said second block in series through equivalent capacitances formed by the connection of the leading and trailing electrodes, and the high frequency side skirting characteristic of a combline type BPF is obtained by the resonators of said second block connected in series through equivalent coaxial lines formed by their parallel arrangement in said second block.

2. A microwave band pass filter according to claim 1, wherein said second block contains three resonators and the series of blocks contains a total of five resonators.

3. A microwave band pass filter according to claim 1, wherein said resonators of said first and third blocks are configured to have a different length of equivalent coaxial lines than those of said second block, such that the overall series has an improved characteristic of suppressing spurious resonance frequencies.

* * * * *